US005360178A

United States Patent [19]

Arnold

[11] Patent Number: 5,360,178

[45] Date of Patent: Nov. 1, 1994

[54] MULTIPLE COILING MACHINE FOR WINDING ELECTRICAL COILS

[75] Inventor: Ernst Arnold, Buchs, Switzerland

[73] Assignee: Meteor AG, Ruschlikon, Switzerland

[21] Appl. No.: 863,674

[22] Filed: Apr. 1, 1992

[30] Foreign Application Priority Data

Apr. 5, 1991 [CH] Switzerland ..... 01 020/91-3

[51] Int. Cl.[5] ..... H01F 41/06

[52] U.S. Cl. ..... 242/7.09

[58] Field of Search ..... 242/7.07, 7.08, 7.09, 242/7.11

[56] References Cited

U.S. PATENT DOCUMENTS

| | | | |
|---|---|---|---|
| 4,121,627 | 10/1978 | Schmid | 242/7.09 X |
| 4,157,165 | 6/1979 | Bierman et al. | 242/7.09 |
| 4,722,486 | 2/1988 | Camardella | 242/7.09 X |

FOREIGN PATENT DOCUMENTS

| | | |
|---|---|---|
| 2654032 | 6/1978 | Germany . |
| 3145179A1 | 5/1983 | Germany . |
| 3609896 | 10/1987 | Germany . |
| 3910361 | 10/1990 | Germany . |

*Primary Examiner*—Andrew M. Falik
*Attorney, Agent, or Firm*—Burns, Doane, Swecker & Mathis

[57] ABSTRACT

A multiple coiling machine for winding electrical coils with different coil wires and different coil wire gauges . A wire guide head is pivotally mounted on a support and has at least two wire guides offset from each other. The wire guide head is pivotable so that one of the wire guides is in a winding position and the other wire guide is in a stand-by position. Two clamps are positioned on the head adjacent the pivot axis of the wire guide head. The wire guide head has a slit in the shape of an arc through which a pair of reversing pins is disposed at a distance from each other on the support. Two clamps and two wire guides are provided on opposite sides of the arc. The coil wire is guided around the reversing pin and can be pulled back into the appropriate wire guide by means of the clamp which is pivotable into the stand-by position. The wire guide head is mounted in a bore of the support by means of a pin, so that it is pivotable. A pair of stop faces limit the pivoting movement of the wire guide head.

14 Claims, 5 Drawing Sheets

FIG. 2c
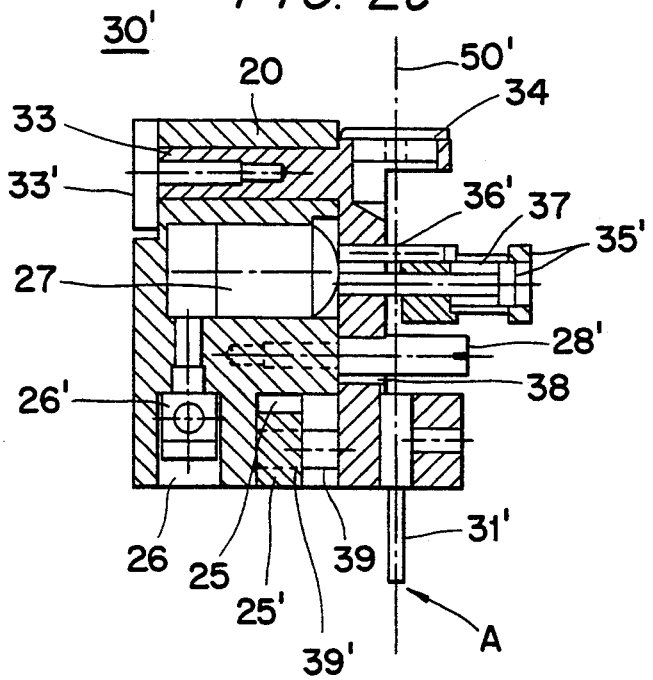
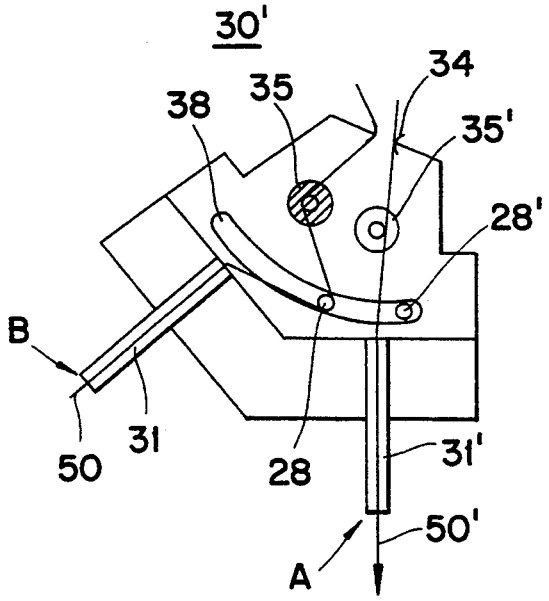
FIG. 2d
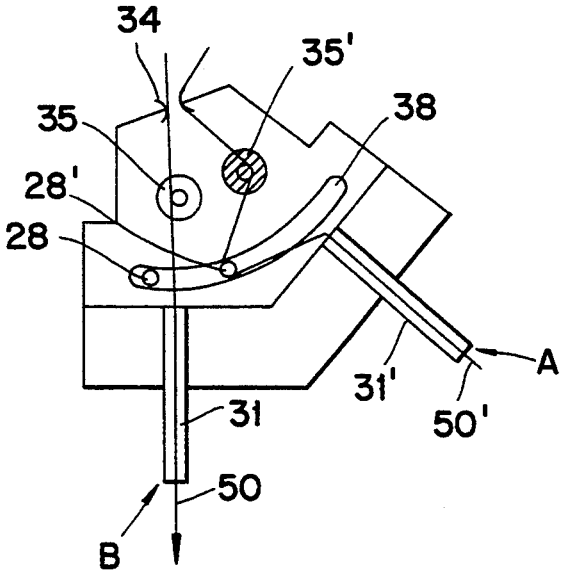
FIG. 2e

MULTIPLE COILING MACHINE FOR WINDING ELECTRICAL COILS

FIELD OF THE INVENTION

The invention relates to a multiple coiling machine for winding electrical coils, having a plurality of winding spindles arranged side by side at a distance from each other and a support extending along the winding spindles in the longitudinal axis of the coiling machine, on which support a wire guide head for each winding spindle is disposed, where the support is axially displaceable and is tiltable crosswise to its long extension, and each wire guide head has a plurality of wire guides for different coil wires and/or different wire gauges.

BACKGROUND OF THE INVENTION

A multiple coiling machine, in which a wire guide is provided not only for the actual winding of the coil body, but also for connecting wire ends to connecting pins, is known from German Patent Disclosure DE 26 54 032. One wire guide for each stationary winding spindle is disposed on a common support rod of this coiling machine. By means of an axial as well as a crosswise movement of the support rod, along with a pivot movement, it is possible to perform the simultaneous winding of a plurality of spindles as well as the connection of the wire ends to connecting pins of the coil bodies.

Coiling machines for winding of electrical coils with multiple windings using wire guides for different coil wires and/or different wire gauges are known from German Patent Disclosures DE 31 45 179 and DE 39 10 361, where a plurality of wire guides with already threaded wires is disposed in a magazine and the appropriate wire guide can be inserted into or removed from the magazine by means of a support rod or an automatic device.

A relatively large amount of space is required with the disposition of the magazines in this way and there is the possibility of disruptions during the insertion or removal of the wire guides, if the guided wires touch.

A coiling device having two wire guides rigidly disposed at a distance from each other on a support and each provided with a clamping device is also known. The range of operation of the coiling device is extremely limited by the two wire guides disposed rigidly and relatively far from each other.

OBJECT AND SUMMARY OF THE INVENTION

Because two different coil wires and/or different wire gauges are sufficient for most uses in connection with electrical coils of this type having a plurality of windings, attempts are being made to reduce the cumbersome insertion and removal of the wire guides and the technical expenditures connected therewith.

It is the object of the invention to make possible the quick exchange of two wire guides with different coil wires and/or different wire gauges in a simple and space-saving manner, while at the same time avoiding the mutual touching of the wires.

The above object is attained by a multiple coiling machine for winding electrical coils of the type having a plurality of winding spindles arranged side by side at a distance from each other, and a support bar extending along the winding spindles, with a wire guide head for each spindle, the support bar being axially displaceable and transversely tiltable, each wire guide head having a plurality of wire guides, the improvement comprising means for mounting the wire guide head for pivoting movement on said support bar, said head having at least two wire guides offset from each other, the wire guide head having clamps, said clamps including a lift pin and a spring opposing the displacement of the lift pin, whereby the guides may be used for different coil wires and for different wire gauges. For example, six wire guide heads disposed on a support and each having two pivotable wire guides disposed offset in respect to each other, allows an extremely space-saving disposition while maintaining the present winding spindle arrangement of the same size and without limiting the operational range of the coiling device.

Due to the fact that one of the wire guides is in the winding position and the other, immediately adjacent one, is pivoted into a standby position, the quick change of the wire guides from the standby position into the winding position and vice versa is assured.

For winding coils where the wire guides in their standby position have longer, trouble-prone wire ends, the latter are pulled back to the minimum length required by an appropriate wire guide head in the course of pivoting of the wire guide from the winding position into the standby position, so that trouble-free winding operations are also assured in connection with such coils.

A wire clamping device allows automatic setting of wire clamping not only for coil bodies with radially, but also with axially disposed connecting pins, so that resetting is not necessary.

BRIEF DESCRIPTION OF THE DRAWINGS

A preferred embodiment of the invention is described in detail below and is illustrated in the accompanying drawings, in which:

FIG. 2*c* is a cross-sectional view of the wire guide head along the line 2—2 in FIG. 2*a;*

FIG. 2*d* is a schematic representation of the wire guide head in the position shown in FIG. 2*a;*

FIG. 2*e* is a schematic representation of the wire guide head in the position shown in FIG. 2;

DETAILED DESCRIPTION OF THE PREFERRED EMBODIMENTS

Figure 1:
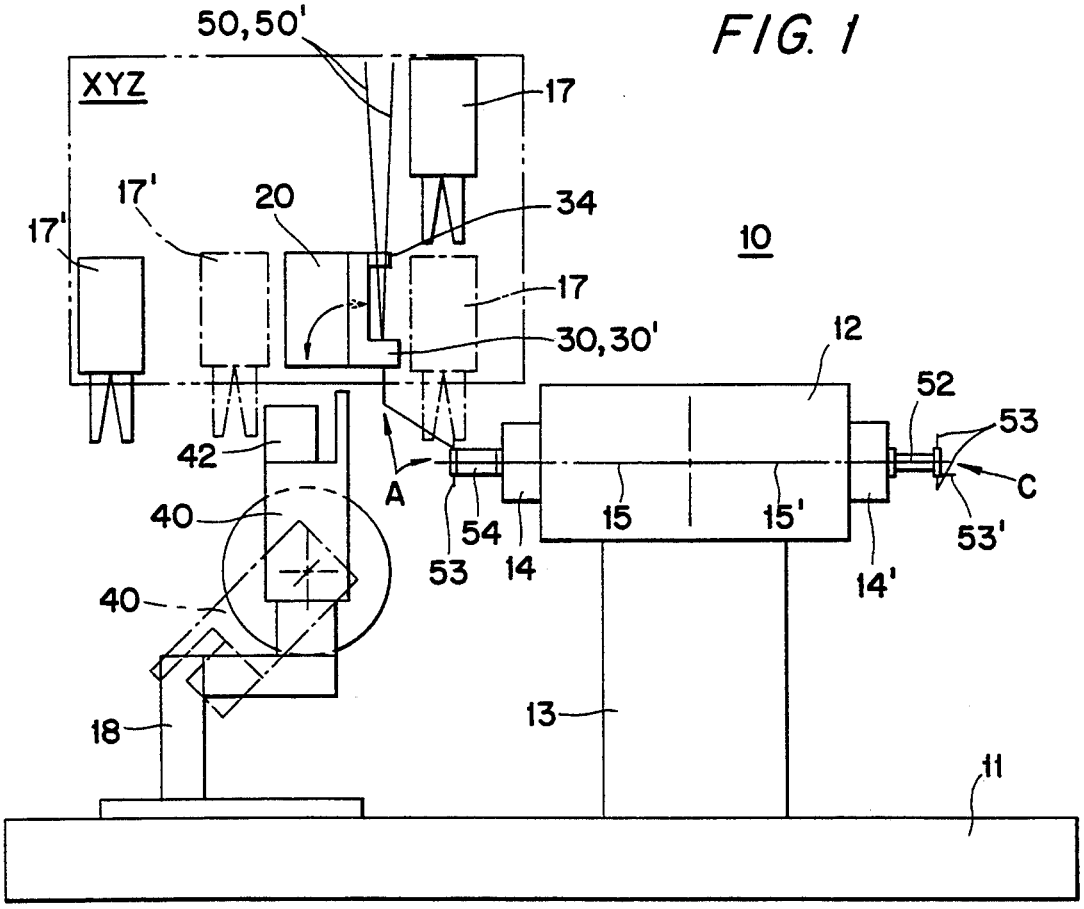
FIG. 1 is a cross-sectional view of a single coiling device of a multiple coiling machine.
Figure 1A:
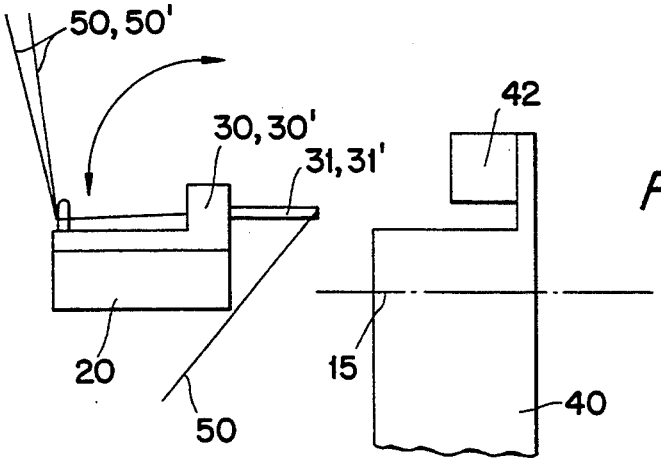
FIG. 1*a* is a detailed cross-sectional view as in FIG. 1.
Figure 2:
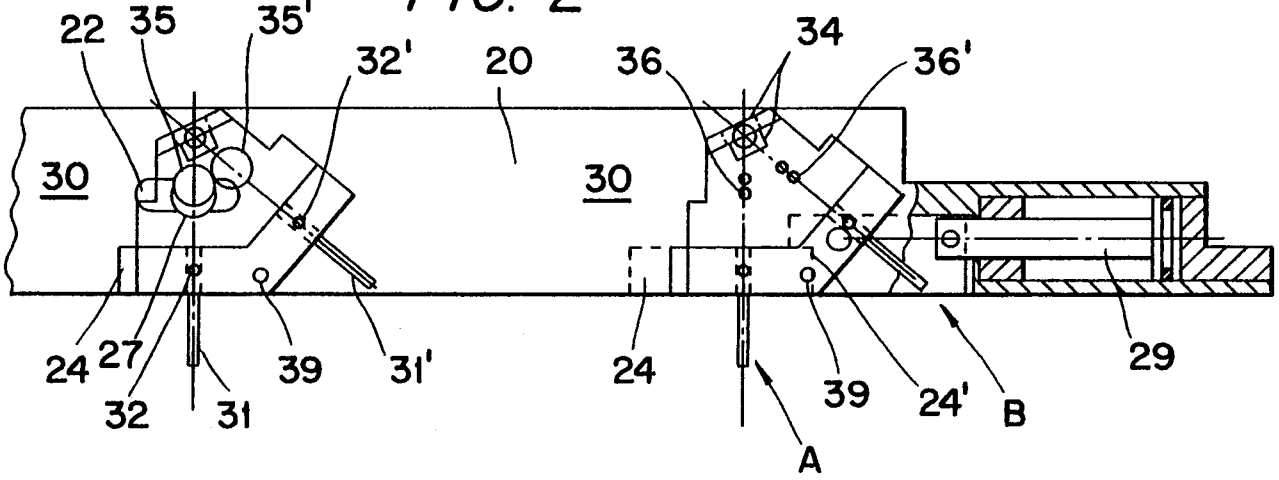
FIG. 2 is a partially cross-sectional view of two wire guide heads in accordance with FIG. 1 mounted on a support of the multiple coiling machine.
Figure 2A:
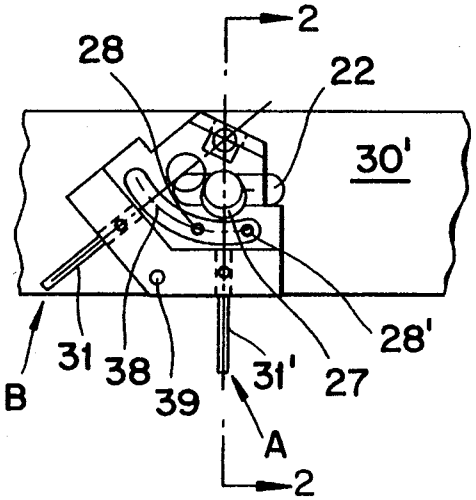
FIG. 2*a* is a view of a wire guide head changed in respect to FIG. 2.
Figure 2B:
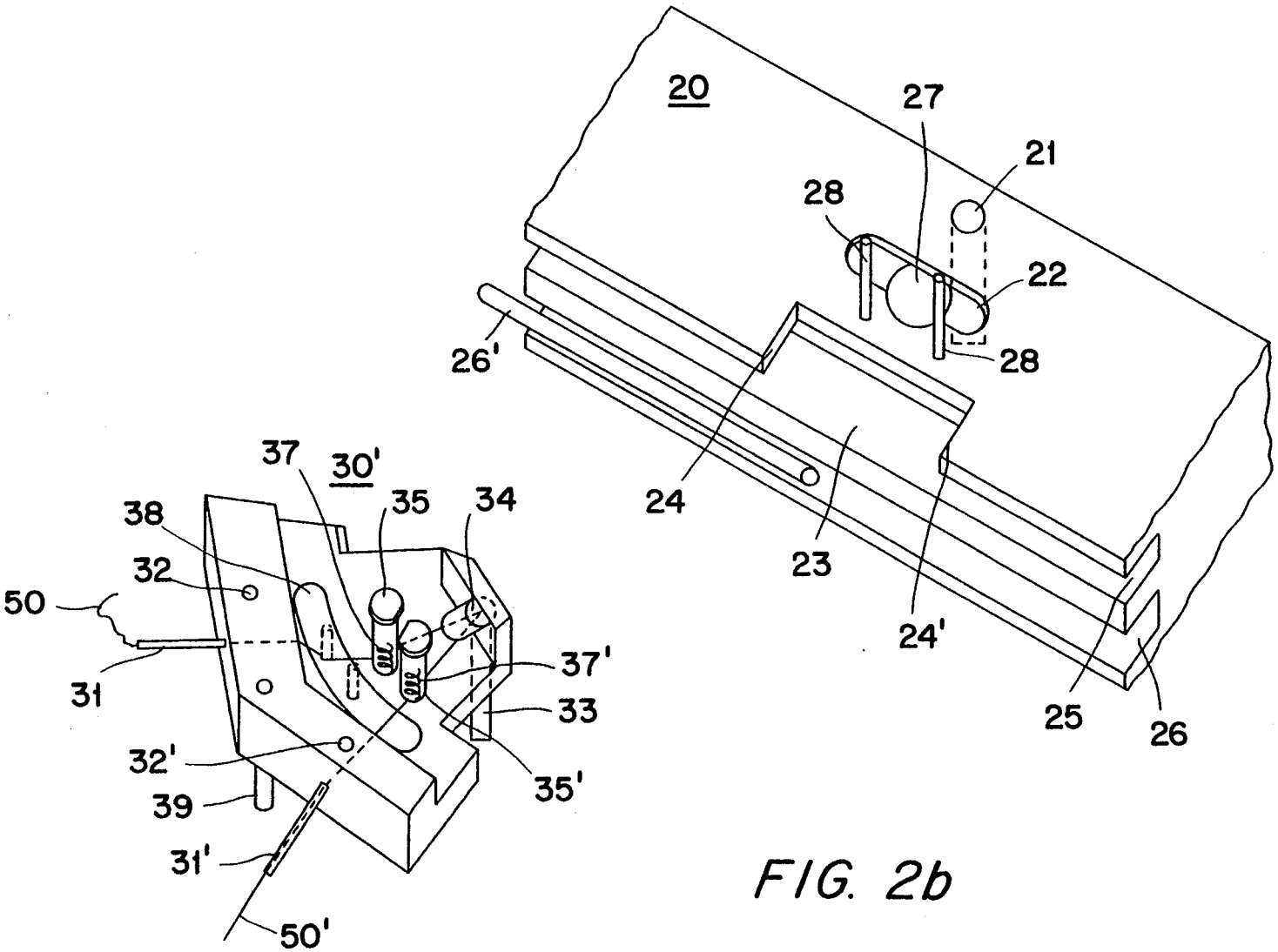
FIG. 2*b* is a perspective view in accordance with FIG. 2*a*, but separated into the support and the wire guide head.

One coiling device of a multiple coiling machine for winding electrical coils, comprising a plurality, for example, six coiling devices, is indicated by the reference numeral 10 in FIG. 1 (and partially in FIGS. 2, 2*a*, 2*b*).

A revolving head 12, having winding spindles guided in holders 14, 14' on winding shafts 15, 15' is mounted on a base plate 11 by means of a stand 13. An unwound coil body 52 is pivoted out of the insertion/removal position C by rotating the revolving head 12 around its perpendicular axis into the winding position A and, at the same time, an already wound coil 54 is pivoted into the removal/insertion position C.

A tiltably embodied support 20 is provided in the long extension of the coiling machine 10, on which a wire guide head 30, 30' cooperating with at least one wire cutting device 17, 17', is disposed for each coiling device. Each wire guide head 30, 30' has a plurality, preferably two, wire guides 31, 31', so that it becomes possible to produce coils 54 of different coil wires 50. 50' and/or different wire gauges without it being necessary to reset the coiling machine. The support 20, together with the wire guide heads 30, 30' and the wire cutting devices 17, 17' can be moved in freely programmable X, Y and Z axes. The support 20 with the wire guide heads 30, 30' is pivotable for connecting the wire ends, and the wire cutting devices 17, 17' are additionally embodied to be perpendicularly or horizontally displaceable.

A cut-off clamping device 40 is provided on a holder 18 supported on the base plate 11. The device 40 is arranged to be pivotable, preferably by 135°, from a working position, shown in solid lines, into a wire release position shown in dashed lines.

In accordance with FIG. 2, the carrier 20 has a pneumatic cylinder 29. The winding spindles are spaced apart from each other along the carrier 20. In accordance with FIGS. 2, 2*a* and 2*b*, wire guide heads 30, 30' are provided for each of the spindles. Each wire guide head 30, 30' has two wire guides 31, 31' and is mounted by means of a pin 33 into a bore 21 of the carrier 20. Each wire guide head 30, 30' is provided with a positioning pin 39, which can be inserted into a bore 39' (FIG. 2*c*) of a rail 25'. Through the operation of the pneumatic cylinder 29, the wire guides 31, 31' are pivoted out of their winding position A into the stand-by position B or vice versa by means of the rail 25' guided in a guide groove 25. The wire guide head 30, 30' is positioned by means of the positioning pin 39, whose horizontal motion effected by the rail 25' is limited by a recess 23 formed in the guide groove 25 by stop faces 24, 24'. A wire eyelet 34 for inserting the winding wires 50, 50' is provided in a trough-shaped recess on the wire-guiding outer surface, in the area of the pin 33.

The wire guide head 30' in accordance with FIG. 2*a* is shown in FIG. 2*c*, wherein the wire guide 31' is in the winding position A. By means of the lifting pin 36' operated by the pneumatic cylinder 29, the wire clamp 35' is lifted counter to the force of the compression spring 37'. The deflection pin 28' is located outside the path of the wire. The winding wire 50' accordingly passes through the wire eyelet 34 and beneath the lifted wire clamp 35' so that the wire is guided freely into the wire guide 31' in the gap formed between the pneumatic cylinder 29 and the wire clamp 35', next to the deflection pin 28'.

In FIG. 2*d*, the wire guide 31' with winding wire 50' is in winding position A, and the wire guide 31 with winding wire 50 is in stand-by position B. In winding position A, winding wire 50' passes through the wire guide head 30' as shown in FIG. 2*c*, and in stand-by position B, winding wire 50 is held securely by the closed wire clamp 35 by means of the effect of the compression spring 37 (FIG. 2*c*). Because of the prior pivoting of the wire guide 31 from the winding position into the stand-by position B, winding wire 50 guided by the deflection pin 28, which protrudes out of the slit 38 in wire guide 31, is pulled back so that the wire only protrudes far enough from the wire guide 31 that it can be securely grasped by the clamping device 40 in accordance with FIG. 3. By this means, malfunctions are avoided during the winding process.

FIG. 2*e* shows the wire guide 31 with winding wire 50 in the winding position B and wire guide 31' with winding wire 50' in the stand-by position A, wherein the clamp 35' (shown in dashed lines) is closed and securely clamps the winding wire 50'. Again because of the prior pivoting of wire guide 31' from the winding position into the stand-by position A, the winding wire 50' guided via the guiding pin 28' protruding from the slit is pulled back to the necessary length in the wire guide 31'.

Each of the wire clamps 35, 35' is provided with a protruding handle (see FIG. 2*b* and the new FIG. 2*c*) so that winding wire 50 or 50' can be threaded by hand at the start of winding or after wire breakage, by lifting the wire clamp 35, 35', even in the stand-by position A or B.

In accordance with FIGS. 2, 2*a* and 2*b*, two wire clamps 35, 35' each are disposed on the wire guide head 30, 30' which have lift pins 36, 36' actuable by means of a pneumatic cylinder 27, on their inner surfaces facing the support 20. The wire guide head 30 that is shown in FIG. 2 adjacent the pneumatic cylinder 29, is shown without its clamps 35, 35' in order to make the lift pins 36, 36' visible. The lift pins 36, 36' extend towards the support 20 into the longitudinal cutout 22 in the area of the pneumatic cylinder. A pressure line 26' disposed in a groove 26 of the support 20 assures the compressed air supply for the pneumatic cylinder 27 for lifting one of the wire clamps 35, 35' by means of the lift pins 36, 36' against the force of a pressure spring 37, 37'. The wire clamp 35, 35' associated with the wire guide 31, 31' which is in the winding position A, is lifted by the lift pin 36, 36' so that the coil wire 50, 50' can be wound on the coil body 52 without braking. During this time the wire clamp 35', 35 associated with the wire guide 31', 31 which is in the standby position B, comes to rest with its lift pin 36', 36 outside of the pneumatic cylinder 27, so that the coil wire 50', 50 remains firmly clamped.

Corresponding to the wound coil 54, the wire end can be cut off in such a way that it extends only a little from the wire guide 31, 31' for gripping or must be cut off at a greater distance from it, so that the wire end extending from the wire guide 31, 31' could cause trouble by touching the coil wires. In the first instance the wire guide head 30 in accordance with FIG. 2 is provided, in the second instance in accordance with FIGS. 2*a* and 2*b*, the wire guide head 30' is additionally provided with a slit 38 in the shape of an arc, into which two reversing pans 28, 28' fastened on the support 20, extend and are guided and reverse the coil wires 50, 50'. In the course of the change of the wire guides 31, 31' from the winding position A into the standby position B the reversing pin 28, 28' located in the slit 38 causes the coil wire to be pulled back, so that again the wired end only extends slightly for gripping out of the wire guide 31, 31'.

The portion of the support 20 and the wire guide head 30' in accordance with FIG. 2*a* is more clearly shown in FIG. 2*b* by showing the support 20 and the wire guide head each separately.

Figure 3:
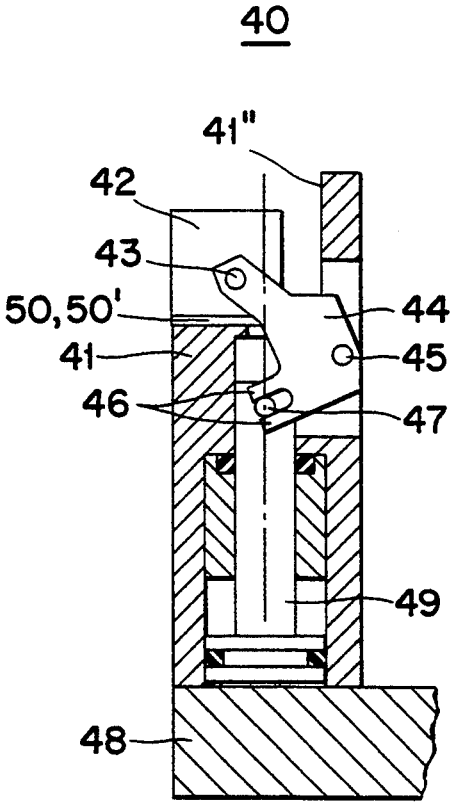
FIG. 3 is a cross-sectional view of a wire clamping device in accordance with FIG. 1, set for winding coils with radially disposed connecting pins.
Figure 3A:
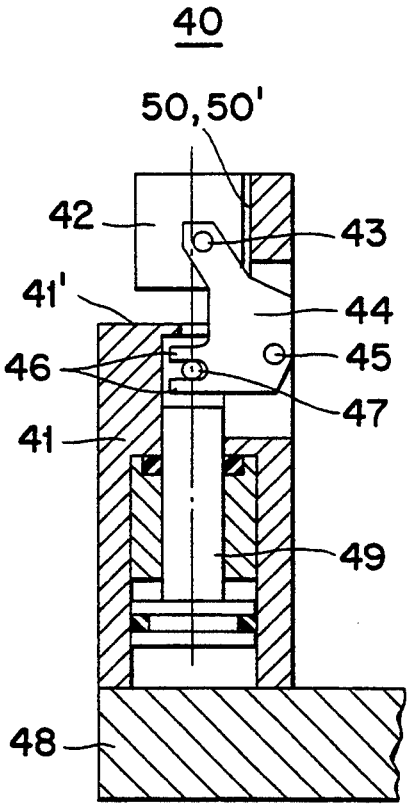
FIG. 3*a* is a cross-sectional view of a wire clamping device in accordance with FIG. 1, set for winding coils with axially disposed connecting pins.

In accordance with FIGS. 3, 3*a*, the wire clamping device 40 is in its operating position for winding electrical coils having radially or axially disposed connecting pins 53, 53' (FIG. 1). Quick conversion without resetting the coiling device 10 is assured in this way. The wire clamping device 40 is disposed on a pivotable holder 18. A pneumatic cylinder 49 with a guide pin 47 is disposed in a housing 41, which is engaged by a fork 46 of a lever 44, rotatable around the fulcrum 45. The lever 44, via a shaft 43 acting on it, actuates a pivotable clamp plate 42. To wind electrical coils 54 with radially disposed connecting pins 53, the coil wire 50, 50' is inserted between the clamp plate 42 and a lateral surface 41'' (FIG. 3) of the housing 41 and clamped in accordance with FIG. 3*a*. To wind electrical coils 54 with axially extending connecting pins 53', the coil wire 50, 50' is inserted between the clamp plate 42 and a front surface 41' (FIG. 3*a*) of the housing 41 and clamped in accordance with FIG. 3. In accordance with FIG. 1, pivoting through an angle between 90° and 180°, preferably 135°, from the working position (shown in solid lines) into a wire release position (shown in dashed lines) takes place to remove the wire ends from the wire clamping device 40. The wire end is discarded by clearing the clamp plate 42 and the wire ends are transported into a collecting container by means of a conveyor belt, not shown.

While this invention has been illustrated and described in accordance with a preferred embodiment, it is recognized that variations and changes can be made without departing from the scope of this invention as set forth in the claims.

What is claimed is:

1. In a multiple coiling machine for winding electrical coils of the type having a plurality of winding spindles arranged side by side at a distance from each other, and a support bar extending along the winding spindles, with a plurality of wire guide heads mounted on the support bar, each spindle cooperating with one of the heads, each wire guide head having a plurality of wire guides, the improvement comprising:

means for mounting the wire guide heads for pivoting movement on said support bar between a winding position and a stand-by position, said heads each having at least two wire guides offset from each other and having a clamp for each wire guide, said means for mounting including actuator means for causing pivoting movement of said heads in unison relative to said support bar, said clamps including a lift pin and a spring opposing the displacement of the lift pin, whereby the guides may be used for different coil wires and for different wire gauges.

2. A coiling machine in accordance with claim 1, wherein each wire guide head with its wire guides is pivotable by means of a pin which can be inserted into a bore of the support.

3. A coiling machine in accordance with claim 1, wherein the pivoting movement of the wire guides is limited by a stop pin.

4. A coiling machine in accordance with claim 1, wherein the actuator means is operable to cause pivoting movement of the wire guides through an angle between 50° and 70°.

5. A coiling machine in accordance with claim 1, wherein the pivotable wire guide head has a slit in the shape of an arc between the clamps and the wire guides, through which extend two reversing pins, disposed at a distance from each other on the support bar and cooperating with the clamps of the wire guide head.

6. A coiling machine in accordance with claim 1, including a pair of reversing pins fixed on the support bar for each spindle, the wire guide heads each having a slot through which the pins extend, whereby upon pivoting of the heads into the standby position one of the reversing pins draws coil wire that is guided around the reversing pin back into the respective wire guides.

7. A coiling machine in accordance with claim 1, including a pneumatic cylinder and a pair of lift pins in the clamp, said cylinder supported to rest, with its front face centered in a longitudinal cutout, against one of the two lift pins of the clamp.

8. A coiling machine in accordance with claim 1, wherein the support bar, together with the wire guides of the wire guide head, includes means for being pivoted in a crosswise direction in respect to the wire guides when they are in the winding position.

9. A coiling machine in accordance with claim 1 wherein the pivoting movement of the wire guide head on the support bar defines an included angle that is between 50° and 70°.

10. A coiling machine in accordance with claim 1, wherein the mounting means includes means mounting the support bar and the wire guide head and the wire guides together to form a unit.

11. A coiling machine in accordance with claim 10, wherein the machine includes a cut off clamping device for holding a wire while the wire is being cut after winding, the cut off clamping device includes a housing with a pneumatic cylinder, a clamp plate and lever pivotable around a fulcrum, and the lever engages on the one hand a guide pin of the pneumatic cylinder by means of a fork and, on the other hand, is connected with a shaft of the clamp plate.

12. A coiling machine in accordance with claim 11, wherein the clamp plate is mounted on the pivotable lever for movement by the guide pin selectively toward a lateral surface or a front surface of the housing of the cut off clamping device for winding a coil body.

13. A coiling machine in accordance with claim 11, wherein the wire clamping device includes means for pivoting the housing in a counterclockwise direction from the winding position into a position where it releases the wire after the wire has been cut.

14. A coiling machine in accordance with claim 13, wherein the pivot angle of the housing is between 90° and 180°.

* * * * *